United States Patent [19]

Watanabe

[11] Patent Number: 4,531,250

[45] Date of Patent: Jul. 30, 1985

[54] WATER TURBINE AND BRUSH HEAD USING THE WATER TURBINE FOR CLEANING PIPES

[75] Inventor: Yoshinori Watanabe, Tokyo, Japan

[73] Assignee: Kyowa Kikai Kogyo Kabushiki Kaisha, Tokyo, Japan

[21] Appl. No.: 501,193

[22] Filed: Jun. 6, 1983

[30] Foreign Application Priority Data

Sep. 20, 1982 [JP] Japan ..... 57-162298
Oct. 2, 1982 [JP] Japan ..... 57-173745

[51] Int. Cl.[3] ..... B08B 9/02; A46B 13/06
[52] U.S. Cl. ..... 15/104.12; 15/29
[58] Field of Search ..... 15/24, 29, 104.12, 104.14, 15/104.09; 415/90, 203, 503

[56] References Cited

U.S. PATENT DOCUMENTS

| | | | |
|---|---|---|---|
| 588,830 | 8/1897 | Jones | 15/104.12 |
| 1,584,740 | 5/1926 | Denny | 415/503 |
| 1,641,494 | 9/1927 | Joseph | 15/24 |
| 1,920,077 | 7/1933 | Hanelt | 15/104.12 |
| 4,207,640 | 6/1980 | Sekula et al. | 15/29 |

FOREIGN PATENT DOCUMENTS

| | | | |
|---|---|---|---|
| 691415 | 7/1930 | France | 15/104.12 |
| 728182 | 4/1932 | France | 15/29 |

*Primary Examiner*—Edward L. Roberts
*Attorney, Agent, or Firm*—Gordon W. Hueschen

[57] ABSTRACT

The water turbine provided by the present invention comprises a rotor which forms a rotor blade on one end and is bored with an exhaust liquid channel on the center of the axis to open to the center of the rotor blade, an inner casing which is bored with a nozzle on the circumference thereof and which supports said rotor in a manner to surround the rotor blade of the rotor and an outer casing having a liquid inlet port which defines a pressure chamber with the inner casing, and can be made so compact as to be held in a hand. The brush head for the pipe cleaning device which utilizes the water turbine as a driving source is so constructed that a brush is formed on an end of the rotor of the water turbine wherein the dirt or scale adhered to the inner surface of a pipe are peeled off with a rapidly revolving brush and then washed away with the pressurized liquid which has been used for revolving the water turbine.

5 Claims, 6 Drawing Figures

WATER TURBINE AND BRUSH HEAD USING THE WATER TURBINE FOR CLEANING PIPES

BACKGROUND OF THE INVENTION

1. Field of the Invention

This invention relates to a brush head for cleaning the inside of pipes or hoses made of synthetic resin or metal such as pipes widely used in transporting fluid, powder or grains between apparatuses or plants and heat exchange tubes used in a reactor at nuclear power stations, and to a water turbine suitable for use as a driving source for such a cleaning brush.

2. Description of the Prior Art

Pipes used for fluid transportation or heat exchange must be periodically cleaned of scales or dirts adhered to the internal surface thereof. In the case of pipes used for transporting dairy products, wine, or other food products or their materials, the inside of those pipes is periodically cleansed as the residues or the waste of material adhered to the internal surface of those pipes narrows the flow path to cause stagnation and are undesirable in view of hygiene. The heat transmission pipes used for a heat exchanger must be cleansed to remove scales adhered thereto as they impair the heat conductivity. Even at home, pipes of a water boiler for bath should be cleaned of furs as they spoil the pleasure of taking bath.

In the prior art, those pipes are chemically cleaned by passing a cleaning agent through the pipes or are manually cleaned by scraping the dirts or scales with a brush after loosening them with a cleaning agent, or flushing water or a mixture of water and sands therethrough. The cleaning methods above described are problematic in that they are uneconomical as they require a large volume of cleansing water or expensive cleaning agent or that they cannot sufficiently clean all the nooks and the corners in the pipes.

Pipes of a bellow type of which inner surface is not even are especially problematic as they are susceptible to scale adhesion as well as difficult to clean. In the case of long pipes or bent pipes, it is almost impossible for an operator to clean them with a brush, and those pipes cannot be flushed fully with chemical agents or by water injection. In the case where food and/or beverage products are transported through such pipes, chemical agents or cleansing liquids cannot be used for cleaning. A cleaning device which can mechanically clean the internal surface of pipes, therefore, has long been demanded.

As a mechanical cleaning device in the prior art, there has been known a brush which is inserted into a pipe via a flexible tube made of steel and rotated for cleaning by an electric motor located outside the pipe. Such a device, however, is detrimental because it often damages the inner surface of the pipe or its movement is restricted in a narrow space inside a curved or a bent pipe because as the steel flexible tube itself is rotated.

The above mentioned problem might be solved by a small sized driving source which can be freely moved together with the cleaning brush inside a pipe. However, as an electric motor which is compact enough to go inside a pipe can seldom be potent enough to provide a powerful rotation needed for removing firmly adhered scales or can endure severe conditions such as being used in the water, no such device has been put to practice.

SUMMARY OF THE INVENTION

The primary object of the present invention is to provide a cleaning device which can mechanically clean the inside of pipes of various types. The secondary object of this invention is to provide a cleaning device which can mechanically clean the inside of pipes even if they are bent or curved and/or elongated pipes. The third object of this invention is to provide a novel water turbine of a compact size which can be used as a driving source for such pipe cleaning device, and more particularly which can be inserted into a pipe having a diameter of several centimeters.

Those objects can be attained by a brush head for cleaning pipes which is attached to an end of a rotor of a water turbine comprising the rotor which forms a rotor blade in one direction and which is axially perforated with an exhaust liquid channel having an opening at the center thereof, an inner casing which is perforated with a nozzle on its circumferential surface and which supports said rotor in a manner to surround the rotor blade thereof, and an outer casing which has an inlet port for fluid and defines a pressure chamber with said inner casing, the outlet port of said exhausted liquid channel of the rotor being positioned at the circumferential surfaces of the rotor so as to loosen dirt or scale on the internal surface of a pipe with a brush at the end of the rotor which is rotated at a high speed with the force applied by pressurized liquid which is directed therein as well as to flush such scale with the pressurized liquid after it is used for rotating the water turbine.

Those objects are achieved further by a water turbine comprising a rotor which is formed with a rotor blade in one direction and which is axially perforated with an exhaust liquid channel having an opening at the center of said rotor blade, an inner casing perforated with nozzles on the circumferential surfaces thereof which supports said rotor in a manner to surround the rotor blade thereof, and an outer casing having an inlet port for fluid which defines a pressure chamber with said inner casing.

DETAILED DESCRIPTION OF THE PREFERRED EMBODIMENTS

Figure 1:
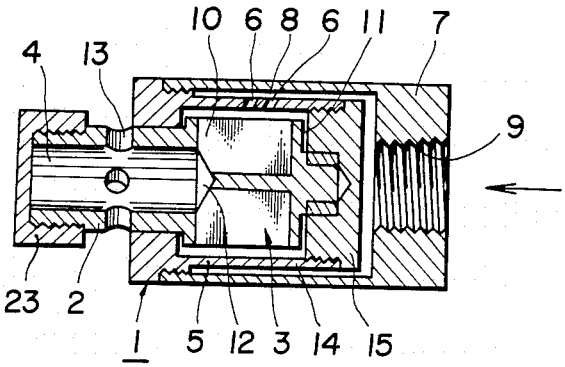
FIG. 1 is a central vertical cross section to show an embodiment of the water turbine according to the present invention.

FIG. 1 shows a water turbine according to the present invention in cross section. The water turbine 1 comprises a rotor 2 which forms a rotor blade 3 in one direction and which is axially perforated with an exhaust liquid channel 4 with an opening at the center of the rotor blade 3, an inner casing 5 which is perforated with nozzles 6 on the circumferential surfaces and which supports said rotor in a manner to surround the rotor blades thereof, and an outer casing 7 having an inlet port for liquid which defines a pressure chamber 8 with said inner casing 5. The rotor 2 of said water turbine 1 is rotated by pressurized liquid supplied from a pressurized liquid supply source 16.

Figure 2:
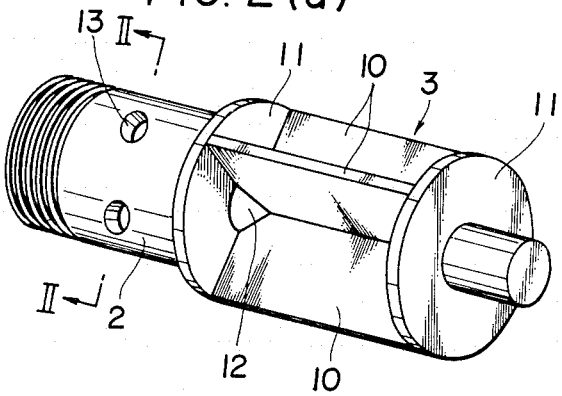
FIG. 2(*a*) is a perspective view to show an embodiment of a rotor while FIG. 2(*b*) is a sectional view along the line II—II thereof.
Figure 2:
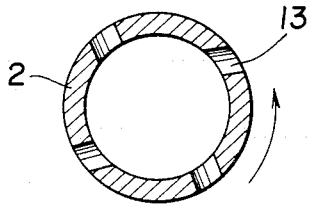

Said rotor 2 is integrally formed with a rotor blade 3. As indicated in FIG. 2(*a*), the rotor blade 3 of the present invention comprises four vanes 10 which are radially arranged and connected to discs 11 at both ends thereof. The number of the vanes 10 of the rotor blade 3 may be arbitrarily selected, but is preferably four, because of ease in manufacture and of the rotational balance. The shape of vanes 10, in the case of this embodiment, is formed like a flat plate; but it may be in a form of a plate curved like an arch. Setting aside the case where the turbine per se is made to extend to several tens of centimeters in its diameter, if it is necessary to reduce the size to a diameter of several centimeters, the experiments confirmed that the rotor blade is preferably shaped like a flat plate rather than a curved plate because of advantages in manufacture as well as in rotational strength.

An exhaust liquid channel 4 is perforated at the axial center of the rotor 2 which forms said rotor blade in one direction. The exhaust liquid channel 4 opens to the center of the rotor blade 3 at one end 12 while it opens to the circumferential surfaces of the rotor 2 at the other end 13 so as to exhaust the pressurized liquid which has been injected from nozzles 6 of the inner casing 5. An outlet port 13 of the exhaust liquid channel 4 is perforated on the circumferential surface of the rotor 2 so as to jet the pressurized liquid toward the periphery of the turbine. In the case of this embodiment shown in FIG. 2(*b*), holes of an identical size are perforated in plurality at an angle with respect of the normal line, i.e., canted at an angle to the normal radius, such as to produce a counterforce at the time of jetting the liquid. If the diameter of the outlet port 13 is made too large, even if it is bevelled or canted, the pressurized liquid will be jetted not obliquely but in the centrifugal direction as it is, thereby losing the function as a reaction turbine. It is therefore not preferable to increase the size without limits. The outlet port 13 of the exhaust liquid channel 4 may be perforated with holes of two different sizes and the holes of a smaller diameter (not shown) may be bevelled. The outlet port 13 of a smaller diameter which is bevelled is mainly intended for incrementing the rotational speed of the turbine with the reaction force generated at the time of jetting pressurized liquid. The outlet port 13 of a larger diameter, on the other hand, is mainly intended to draw off the pressurized liquid. Although not shown in the drawings, the outlet port 13 of the exhausted liquid channel 4 may be opened in the direction of axis of the rotor depending on use. If it is positioned in such a way, the liquid encounters less resistance when directed outside, and the rotor can achieve a higher revolution. In the case where the exhaust liquid channel 4 is perforated in a rotor, it is generally opened to the end of the axis, the opening can be used as an outlet port. If the rotor 2 is threaded and is covered with a cap, either one of the circumferential surface and the end of the axis of the rotor 2 may be selectively utilized as an outlet port 13 to suit the requirements.

The inner casing 5 comprises a cylindrical member 14 which is penetrated by the rotor 2 and which houses the rotor blade 3 and a lid member 15 which doubles as a bearing supporting one end of the rotor 2. The cylindrical member 14 and the lid member 15 are screwed to surround the rotor blade 3 of the rotor 2. The nozzles 6 are perforated on the circumferential surface of the inner casing 5. The nozzles 6 are for jetting the pressurized liquid which has been introduced into the pressure chamber 8 defined between the outer casing 7 and the inner casing 5 toward the rotor blade 3 of the rotor 2 and are bevelled in a manner to direct the jet flow of the liquid on the end of vanes 10. In this embodiment, there are two nozzles 6 bored in parallel so as to jet the liquid toward the same vane 10, but they may be serially bored in circumferentially so as to jet the pressurized liquid toward different vanes 10. In such a case it is desirable to arrange them symmetrically so as not to disturb the balance of revolution nor the revolutional force.

The outer casing 7 is a cylinder which surrounds the inner casing 5 which in turn defines a pressure chamber 8 with the inner casing 5, and which is screwed with the inner casing 5. The outer casing 7 is perforated with a liquid inlet port 9 comprising a screw hole into which a tube 18 for feeding pressurized liquid such as a flexible tube, etc. is inserted.

In the water turbine according to the present invention, pressurized liquid, for instance water, is introduced via the liquid inlet port 9 of the outer casing 7 from the pressurized liquid supply source 16 and is jetted from the nozzles 6 of the inner casing 5 at an accelerated speed against the vanes 10 of the rotor blade 3 so as to rotate the rotor 2 at a high speed. The pressurized liquid is directed out after having rotated the rotor 2 from the outlet port 13 provided on the circumferential surface of the rotor 2.

Figure 4:
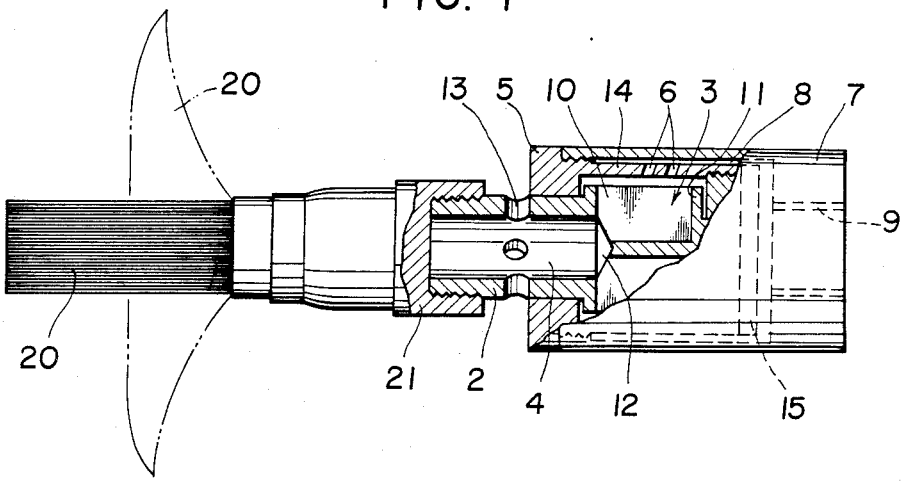
FIG. 4 is a partially sectioned view of a brush head of the cleaning device.

The water turbine having the above mentioned structure is made so compact in size and transportable in structure as to be applicable to various uses. If a brush 20 is mounted on an end of the rotor 2 as shown in FIG. 4, the turbine can be used as a driving source of a cleaning brush head to be used for cleaning the inside of pipes in a wide range from synthetic resin or metal pipes and hoses to tubes for conveying fluid between various apparatuses or plants or transporting grains, or heat exchange tubes for a reactor at nuclear power stations.

Figure 3:
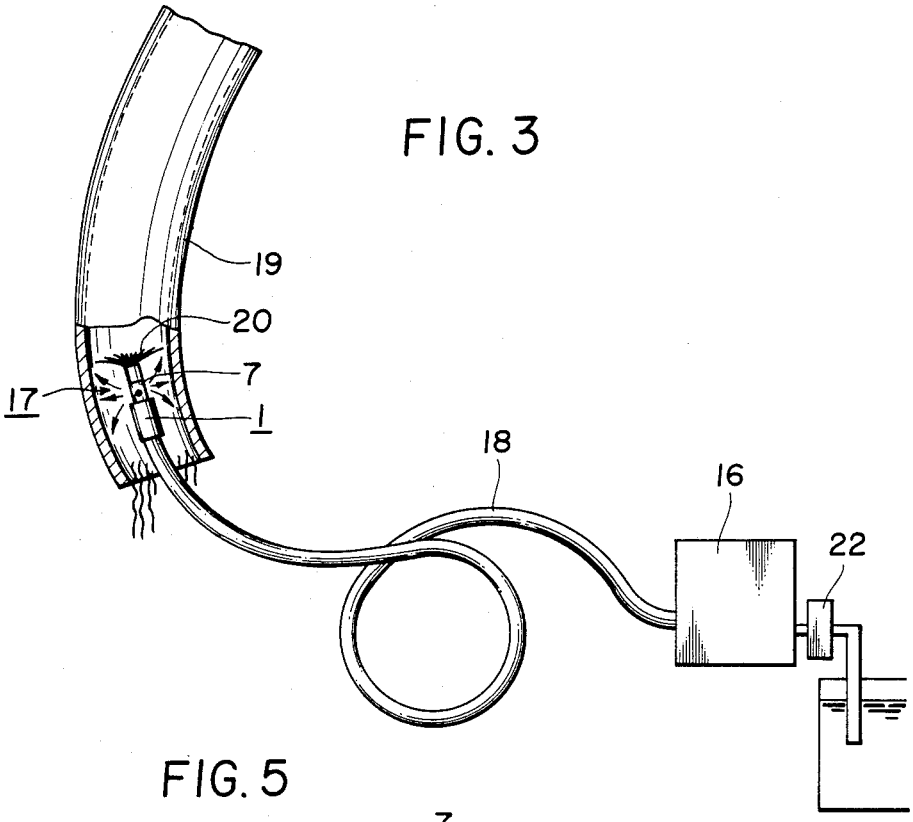
FIG. 3 is a perspective view to show an embodiment where the water turbine according to the present invention is applied to a pipe cleaning device.

FIG. 3 shows an embodiment of the pipe cleaning device using said water turbine as a driving source wherein the device comprises a source of pressure 16, a cleaning brush head 17 comprising a brush 20 mounted on a water turbine 1 and a flexible tube 18 for connecting above components to support the cleaning brush head 17 as well as to feed the pressurized liquid.

The brush 20 is implanted on an attachment 21 which is screwed into a rotor 2 of the water turbine 1 and is mounted on an end of the rotor 2. The brush 20 may be made of synthetic resin fibers, metal wires or any other materials so far as it is suitable for the pipes 19 to be cleaned. For instance, a steel wire brush, a stainless steel wire brush or a brass wire brush is used for metal pipes while a brush made of nylon or other synthetic resins, or nylon mixed with an abrasive agent is used for synthetic resin pipes. Any arbitrary shape may be selected for the brush 20 as long as it is suitable for brushing the internal surface of a pipe. In this embodiment, for instance, a column-like brush made of nylon fibers or steel wires bundled in a large number in the direction of the rotor shaft are used. The columnar brush 20 is adapted to spread by centrifugal force in the form of a funnel to abut against the internal surface of a pipe 19 as the rotor 2 rotates while it stays to have a diameter substantially identical to that of the rotor 2 when it is not rotated. The columnar brush 20 can therefore be used for the pipes falling in the range from a small diameter pipe which barely allows the insertion of the water turbine 1 to a larger pipe which has a radius similar to the length of the brush 20. A wheel type brush (not shown) having radially planted bristles may also be used. Unlike the columnar shaped brush shown in FIG. 4 of which diameter can be varied by the rotation, the wheel brush can only be used for the pipes or a diameter smaller than that of the brush. This, however, does not present a problem if brushes of various sizes corresponding to the size of pipes are prepared. As the wheel type brush is fairly short in its axial length, it can smoothly advance into curved or bent pipes 19. The pressurized liquid supply source 16 may be any known pump. The pressurized liquid source 16 is provided with a cleaner 22 which prevents the nozzles 6 from clogging with impurities mixed in the liquid. Water may be used as the pressurized liquid, but if dirt and scale are excessive, mixture of water and a cleaning agent or any type of cleaning solutions may be used, provided that it is of a low viscosity.

The flexible tube 18 connecting the pressurized liquid source 16 with the cleaning brush head 17 should be a water-tight, pressure-resistant flexible pipe which has rigidity, as it acts as a manipulating rod for inserting the brush head 17 into the pipe 19. For instance, a rubber nose reinforced with wire or coil or a synthetic resin tube is suitable.

The cleaning brush head of the structure according to the present invention and a cleaning device incorporating the same are operated in a manner described below. The pressurized liquid, for instance water, is introduced into the brush head 17 in the pipe 19 via the flexible tube 18 from the pressurized liquid source 16. The pressurized liquid is introduced into a pressure chamber 8 defined by an outer casing 7 and an inner casing 5, and then jetted against the vanes 10 of the rotor blade 3 at a higher velocity accelerated by the nozzles 6. The jetted liquid revolves the rotor blade 3 and the rotor 2. The pressurized liquid is directed through the exhaust liquid channel 4 to be jetted out from the outlet port 13 located on the circumferential surface of the rotor after having caused the rotor blade 3 to revolve. The reactional force generated by the injection further energizes the revolution on the rotor 2. As the rotor 2 revolves, the brush 20 mounted thereon is caused to spread like a funnel by the centrifugal force to be forced against the inner surface of the pipe 19 while it is revolving. As the brush 20 which is being spread by the centrifugal force moves along the inner contour of the pipe 19 in a manner to closely brush thereon at a higher speed, even if the pipe 19 is crushed or of other irregularities, it can mechanically peel off dirt or scale adhered to the inner surface of the pipe 19. A portion of the pressurized liquid which is jetted from the rotor 2 and splashed against the internal surface of the pipe 19 is supplied to the brush 20 for facilitating cooling of the brush 20 and cleansing of the inner surface of the pipe 19.

The rest of the pressurized liquid flows toward the pipe inlet side to clean the inside of the pipe 19 by removing the dirt and scale which have been peeled off by the brush 20. As the pressurized liquid supplied on the side of the brush 20 is a portion of the liquid which has crushed against the internal surface of the pipe 19 and has somehow lost the original intensity, it does not force the spread brush 20 to narrow its diameter extension, but instead wets and permeates into those dirt and scale for facilitating peeling and removing the same.

Cleaning operation of the pipe, therefore, can be performed simply by holding the flexible tube 18 by hand and by feeding the brush head 17 into the pipe 19. Even if the pipe 19 is bent, the flexible tube 18 can advance along the contour of the pipe 19 for pushing the brush head 17 for cleaning operations. The brush 20 of the cleaning brush head 17 which is supported by a flexible tube 18 can easily clean not only straight pipes but also bent pipes or pipes of special configuration.

Cleaning operation inside pipes located in an endangering environment where an operator is not permitted access because of the toxicity or radioactive contamination can be performed simply if the above mentioned cleaning brush head 17 is mounted on a straight pipe or a flexible tube which is automatically let out and pressurized liquid is supplied thereto by a remote control. The above method can be applied to clean the tubes used for heat exchange of a nuclear reactor at a nuclear power station.

At private homes, the flexible tube 18 may be connected to a faucet to allow the use of water for rotating the water turbine 1 for cleaning glasses bottles or bath boilers.

As is evident from the foregoing description, the cleaning brush head according to the present invention can peel off dirt and/or scale inside a pipe with a rapidly revolving brush and can wash out the same with pressurized liquid as it is adapted to rotate a water turbine mounted with a cleaning brush with pressurized liquid, and the same pressurized liquid previously used for water turbine revolution is jetted out from the rotor circumference surface. If a columnar brush having bristles implanted in the axial direction of the rotor is used, bristles of the brush are spread by centrifugal force in a form of a funnel to be pressed abuttingly against the inner surface of a pipe only when the brush is rotated, and it cah reliably clean special pipes of which the diameter is varied, bellowed pipes, crushed pipes or deformed pipes. If the outlet of the exhaust liquid channel on the rotor circumference is bevelled, the revolution of the rotor will be accelerated by the reacion generated at the time of exhaustion/injection, thereby enhancing the cleaning effect. As the pipe cleaning device using such a cleaning brush head is so constructed that a compact cleaning brush head is supported by a flexible tube through which pressurized liquid is fed from the liquid source, the cleaning brush head can freely be moved inside a tube/pipe for cleaning simply by letting the flexible tube in or out of an elongated or belt pipe.

According to the brush head and the pipe cleaning device using the water turbine according to the present invention, the brush head can be made compact, thereby enabling it to clean easily the inside of a pipe no matter how bent or elongated it is.

Figure 5:
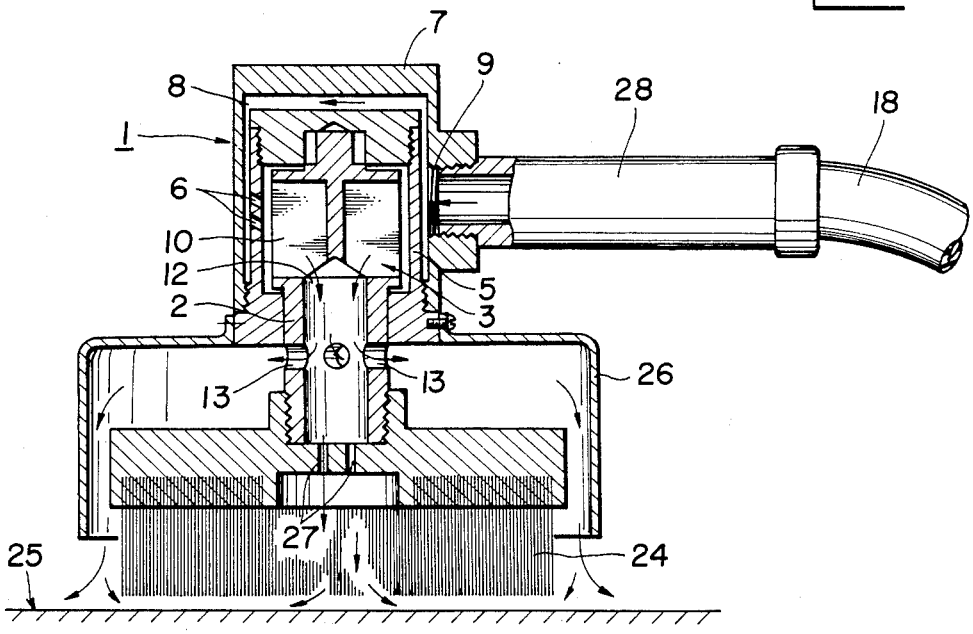
FIG. 5 is a partially sectioned view to show another embodiment of the water turbine.

As indicated in FIG. 5, the water turbine 1 according to the present invention can be applied as a driving source for a cleaning device which cleans comparatively flat surfaces of an automobile or a large sized tank.

In the above case, the brush 24 must not spread with the revolution unlike the brush 20 in FIG. 4, but it should closely brush on the surface perpendicular to the axial center of the rotor 2. Therefore, it is preferable to use a brush having a comparatively short bristles implanted in the direction of the rotor axis.

In order not to disperse the water jetting from the outlet port 13 provided on the circumferential surface of the rotor 2 but to direct the jet flow onto the surface 25, a cover 26 is attached to an outer casing 7 to cover the periphery of the rotor 2 and the end portion of the brush 24. If the main stream of the jetting water is directed from the axial end of the rotor 2 to inside of the brush 24, the cleaning effect cannot be improved because of the water film formed between the brush 24 and the surface 25 to be cleaned. But if a portion of the jetting water is jetted from the center of the brush 24, it rapidly removes the stains and/or scale which has become peeled off with the brush 24, thereby preventing the surface from damages which otherwise are caused by those scale or stains. An injection nozzles 27 smaller than the outlet 13 of the rotor 2 may be bored at the center of the brush 24.

The liquid inlet port 9 may be bored not only on the rear end but also on the circumference of the outer casing 7. For instance, a liquid inlet port 9 is bored on the circumference of the outer casing 7 for connecting a pipe 28 which doubles as a handle so that cleaning in the direction either lateral or downward can be performed.

In the cleaning device for plate-like objects using a water turbine 1 as a driving source according to the present invention, the brush 24 is revolved at a high speed with a pressurized liquid to peel off the dirt and/or scale, the pressurized liquid after used for revolving the brush 24 is directed along the cover 26 and jetted against the surface 25 from the periphery of the brush 24 so as to cool the brush 24 as well as to wash down the dirt thereon, enabling cleaning operation at higher efficiencies.

What we claim is:

1. A cleaning brush head comprising a turbine which comprises a rotor having a rotor blade means on one end and brush means on the other end, the improvement in which said rotor is bored at the axial center thereof to provide an exhaust channel at the center thereof for conducting spent propellant from said rotor blade means and is provided with a housing for said rotor blade means comprising an inner casing which has nozzles bored in the circumference thereof for directing propellant onto said rotor blade means, and an outer casing which defines a pressure chamber with said inner casing for supplying pressurized propellant to said nozzles, and means for supplying pressurized propellant to said pressure chamber, said exhaust channel comprising outlet port means formed in the circumference surface of the rotor exterior of said housing adapted to jet spent propellant radially at an angle canted to the normal such as to augment the rotation of the rotor.

2. A cleaning brush head comprising a brush on an end of a rotor of a turbine which comprises a rotor having a rotor blade means at one end thereof and a drive shaft at the other end thereof, which rotor is bored at the axial center thereof with an exhaust channel communicating with an opening at the center of the rotor blade means, a housing for said rotor blade means comprising an inner casing and an outer casing, said inner casing having a nozzle means perforated in the circumference thereof in a manner to direct pressurized propellant onto said rotor blade means and said outer casing having an inlet port for introducing pressurized propellant and defining a pressure chamber with said inner casing for supplying pressurized propellant to said nozzle means, and outlet means for spent propellant comprising jet ports in said drive shaft which are canted to induce a reaction which augments the rotation of said drive shaft.

3. A cleaning brush head as claimed in claim 2, in which said exhaust liquid channel also comprises an axial port whereby the exhaust water is jetted both axially and radially.

4. A pipe cleaning brush head comprising a water turbine having a rotor and a brush attached thereto, said brush comprising axially-disposed, long bristles of flexible material which, as a result of the centrifugal force induced by the rotation of the rotor, flare out into contact with the pipe, said turbine having a plurality of radially-disposed water exhaust ports arranged to direct jets of water without substantial axial components against the inner surface of said pipe adjacent said brush, whereby the exhaust water is jetted into contact with the pipe adjacent the flared-out rotary bristles and functions to wash out scale and to clean the brush, and in which the exhaust ports are so arranged that water is jetted radially at an angle to the normal radius of the rotor, which angle complements the rotation of the rotor by the reaction of the water jetted through said outlet port.

5. A cleaning brush head comprising a turbine which comprises a rotor having a rotor blade means at one end thereof and a drive shaft at the other end thereof, which rotor is bored at the axial center thereof with an exhaust channel communicating with an opening at the center of the rotor blade means, a housing for said rotor blade means comprising an inner casing and an outer casing, said inner casing having a nozzle means perforated in the circumference thereof in a manner to direct pressurized propellant onto said rotor blade means, and said outer casing having an inlet port and defining a pressure chamber with said inner casing for supplying pressurized propellant to said nozzle means, a brush attached to said rotor and comprising a brush head having bristles normal thereto and a central opening therein a cover attached to said outer casing and having a downwardly extending wall enclosing a portion of said brush, and means for directing jets of spent propellant through the central opening of said brush and also about the periphery thereof against said downwardly extending wall to direct propellant against a work surface adjacent said brush.

* * * * *

UNITED STATES PATENT AND TRADEMARK OFFICE

CERTIFICATE OF CORRECTION

PATENT NO. : 4,531,250

DATED : July 30, 1985

INVENTOR(S) : Yoshinori Watanabe

It is certified that error appears in the above-identified patent and that said Letters Patent is hereby corrected as shown below:

Col. 6, line 22; "glasses bottles" should read -- glasses, bottles --

Col. 6, line 37; "cah" should read -- can --

Col. 6, line 49; "belt" should read -- bent --

Col. 6, line 62; "the" (first occurrence) should read -- a --

Col. 7, line 12; "scale" should read -- scales --

Col. 7, line 12; "nozzles" should read -- nozzle --

Col. 8, line 48; "therein a" should read -- therein, a --

Signed and Sealed this

*Seventh* Day of *January 1986*

[SEAL]

*Attest:*

*Attesting Officer*

DONALD J. QUIGG

*Commissioner of Patents and Trademarks*